United States Patent [19]

Artzt et al.

[11] 4,201,037

[45] May 6, 1980

[54] METHOD AND APPARATUS FOR CLEANING FIBROUS MATERIAL

[75] Inventors: Peter Artzt, Pfullingen; Rudolf Hehl, Albstadt; Gerhard Egbers, Reutlingen; Anton Schenek, Bempflingen, all of Fed. Rep. of Germany

[73] Assignee: Schubert & Salzer, Ingolstadt, Fed. Rep. of Germany

[21] Appl. No.: 844,708

[22] Filed: Oct. 25, 1977

[30] Foreign Application Priority Data

Oct. 27, 1976 [DE] Fed. Rep. of Germany ..... 2648715

[51] Int. Cl.[2] ..... D01H 11/00; D01H 1/12

[52] U.S. Cl. ..... 57/301; 57/58.91; 57/58.95

[58] Field of Search ..... 57/56, 58.91, 58.95, 57/301; 15/305, 306 A; 19/105

[56] References Cited

U.S. PATENT DOCUMENTS

| | | | |
|---|---|---|---|
| 3,728,853 | 4/1973 | Schiltknecht . | |
| 3,763,641 | 10/1973 | Doudlebsky et al. | 57/56 |
| 3,777,466 | 12/1973 | Kabele et al. | 57/56 X |
| 3,792,575 | 2/1974 | Doudlebsky et al. | 57/56 |
| 3,834,145 | 9/1974 | Ellingham et al. | 57/301 |
| 3,884,028 | 5/1975 | Stahlecker et al. | 57/56 |
| 3,892,063 | 7/1975 | Doudlebsky et al. | 57/56 |
| 3,953,961 | 5/1976 | Harrap et al. | 57/301 |
| 3,975,895 | 8/1976 | Stahlecker . | |
| 4,009,562 | 3/1977 | Stalder | 57/56 |

FOREIGN PATENT DOCUMENTS

| | | | |
|---|---|---|---|
| 74205 | 12/1975 | German Democratic Rep. . | |
| 433272 | 1/1923 | Fed. Rep. of Germany . | |
| 426285 | 10/1924 | Fed. Rep. of Germany . | |
| 2108254 | 8/1972 | Fed. Rep. of Germany | 57/58.91 |
| 2248396 | 11/1974 | Fed. Rep. of Germany . | |
| 43-23773 | 6/1968 | Japan . | |
| 47-3794 | 2/1972 | Japan . | |
| 1272529 | 5/1972 | United Kingdom . | |
| 1361986 | 7/1974 | United Kingdom . | |

*Primary Examiner*—Donald Watkins

*Attorney, Agent, or Firm*—Bailey, Dority & Flint

[57] ABSTRACT

A method and apparatus for cleaning fibrous material which is fed in the form of a sliver by a delivery device to an opening roller carried within a housing which opens the fibrous material and feeds the opened fibers to an open-end spinning device. A dust separator opening is provided in the housing between the delivery device and the open-end spinning device. A source of suction is connected to the dust-separator opening and a gauze-like covering extends over the dust-separator opening for maintaining the fibrous material within the effective range of the opening roller as the fibrous material is carried thereover during the opening process. The dust from the fibrous material is withdrawn through the gauze-like covering and the dust-separator opening by the source of suction. The housing can also be provided with a trash separator opening having a separator edge positioned adjacent thereto for separating trash from the fibrous material simultaneously while the dust is being removed therefrom.

11 Claims, 6 Drawing Figures

METHOD AND APPARATUS FOR CLEANING FIBROUS MATERIAL

BACKGROUND OF THE INVENTION

The present invention refers to a method and apparatus of cleaning fibrous material which is fed in the form of a sliver to an opening roller and is opened into individual fibers and, subsequently, fed to an open-end spinning device.

In known opener units of preparatory machines in spinning mills, the coarse impurities such as leaf, stalk and seed-kernal residues are largely removed and eliminated by beating action upon the cotton flock. But in that case, there is effected not only elimination but also partial smashing of these bits, whence arise particles of 300μ and smaller, which cling to the fibers again as microscopic dust. Hence, the fibers remain burdened with considerable amounts of microscopic dust, the greater proportion of which amounts to 150μ or is still finer (Melliand Textilberichte August 1976, pages 609 to 613).

With open-end spinning devices, the practice is known of loosening the sliver as far as single fibers, and in this form, leading it past a trash separator opening which exhibits a separator edge (West German O/S No. 1 914 115). For avoiding loss of fibers, an airstream directed against the direction of flight of the dirty matter is introduced into the fiber-air stream led to the spinning rotor. Dirty matter which is just as light or even lighter than fibers is held back by this infed flow of air just like the fibers and arrives with the fibers in the spinning rotor. Here the fine dust is deposited on the rotor wall and in the collector groove and interfers with the spinning operation. The shape of the groove is continually altered and the spinning process disturbed, whereby yarn breakages arise.

SUMMARY OF THE INVENTION

The above problem is minimized in accordance with the present invention by subjecting the fibrous material to the action of the beater roller and to a flow of air sucked outwards with respect to the beater roller, while the fibrous material is carried circumferentially to the beater roller. Through the high acceleration of the fibers in the region of the beater roller, the fibers are subjected by the roller lining to a high mechanical stress. Large amounts of microscopic dust are thereby rubbed off the surface of the fibers and the fragments of the fiber present in the mass of fibers are released. This fine, dirty matter gets carried away by the suction air flow while the fibers are carried in the direction circumferential to the beater roller and thereby held back.

Preferably, the fibrous material is still retained as a fiber tuft while the flow of suction air is acting on it. By this means, the separative action is still more intensive since the very fine dust gets eliminated in the region in which it gets separated from the fibers, before it can settle between the fibers afresh and have to be loosened out of the fibers once more by the lining/fiber, guide/fiber, and fiber/fiber friction.

In accordance with the invention, for performance of the method, a dust-separator opening is connected to a source of suction air provided between a delivery device and the open-end spinning machine in the wall of the housing surrounding the beater roller, and is provided with a gauze-like covering over which the fibrous material is carried past during the opening process, so that it is kept by the covering within the effective range of the beater roller. Advantageously, the dust-separator opening lies moreover in the region of the fiber tuft. In order to take into account the rapid motion of the dirty matter to be eliminated in the direction circumferential to the opening roller, the dust-separator opening advantageously extends in the direction of the free end of the fiber tuft to beyond it. In order to avoid sucking back into the fiber-air flow, of the very fine dust already eliminated, the dust-separator opening extends by less then 50 percent of the average fiber length beyond the free end of the fiber tuft.

In accordance with a preferred embodiment of the invention, the covering is arranged in continuation of the wall of the housing. In that case, the housing is advantageously provided with a lining which in the region of the dust-separator opening is made as a gauze-like covering.

Depending upon the fibrous material being processed, the dust to be eliminated differs in its character. It is, therefore, advantageous if for adaptation to the kind of material to be processed the covering can be exchanged. The covering may, in that case, extend around to the nip of the delivery device, in which caase in constructing the delivery point as a delivery roller with associated feeding trough at least one part of the covering may be made as an integral component of the feeding trough.

The dust-separator device in accordance with the invention may be used by itself or in connection with a trash-separator opening having a separator edge. In the latter case, the trash-separator opening is provided with a separator edge and follows the dust-separator opening.

For improvement of the conveyance of the fiber from the delivery device to the fiber feed channel, especially after the dust-separator opening in accordance with a further feature of the invention, there is provided in the wall of the housing an air supply opening which with respect to the direction of conveyance of the fiber is before the dust-separator opening. In order to compensate for the proportion of the air sucked away at the dust-separator opening an air supply opening can also be arranged after the dust-separator opening, which is advantageously made as a trash-separator opening.

A porous or perforated partition in the wall of the housing opposite to the periphery of the beater roller in the region of the fiber tuft is indeed already known, which separates the interior of the housing from a suction chamber (West German O/S No. 2 134,342). But this partition, together with the air flow acting upon the fiber tuft through it, has the object of raising the fiber tuft from the beater roller while the spinning device is standing still. Accordingly, it is not a dust-separator opening, since the suction air is not effective during operation of the spinning device. Furthermore, the fibers do not get conveyed along this partition during the opening process but get retained here after raising out of the effective range of the opening roller. A device is furthermore known (Japanese Patent As No. 23 773/71) by which means of a perforated partition too early action of the beater roller upon the fiber tuft is prevented. In the region of this perforated partition, the fiber tuft is not subjected to the action of the beater roller.

A porous partition is likewise known through the West German O/S No. 2 108 254. Air is, however, not sucked through this partition but, on the contrary, fed into the fiber/air flow.

Again, a trash-separator opening equipped with grate bars is known, which on the side remote from the opening roller is screened by a gauze (West German O/S No. 2 038 059, FIGS. 10 to 12). But such a device in a very short time clogs with dirty matter and is then no longer able to work since it does not keep the fibrous material in the effective range of the beater roller and, hence, no fibers get carried past across it, which might clean this gauze again.

An air-permeable feeding trough is already known (Czech Pat. No. 144 745). But air is led in and not out through the air-permeable portion of the feeding trough. Furthermore, in this case, it is not a matter of the covering over a trash-separator opening.

By the device in accordance with the invention, not only are particles of dust and small fragments of fiber arising in the earlier working runs led away, but also the particles of dust and small fragments of fiber which arise during the opening process in the beater device itself are removed. In this way, a considerable reduction in yarn breakages is achieved.

Accordingly, it is an important object of the present invention to provide a method and apparatus which enables fine, dusty matter contained in fibrous material to be separated therefrom.

Another important object of the present invention is to provide a device for separating dust from fibrous material as it is fed round a beater roll for being spun in an open-end spinning device.

These and other objects and advantages of the invention will become apparent upon reference to the following specification, attendant claims, and drawings.

DESCRIPTION OF THE PREFERRED EMBODIMENT

Figure 1:
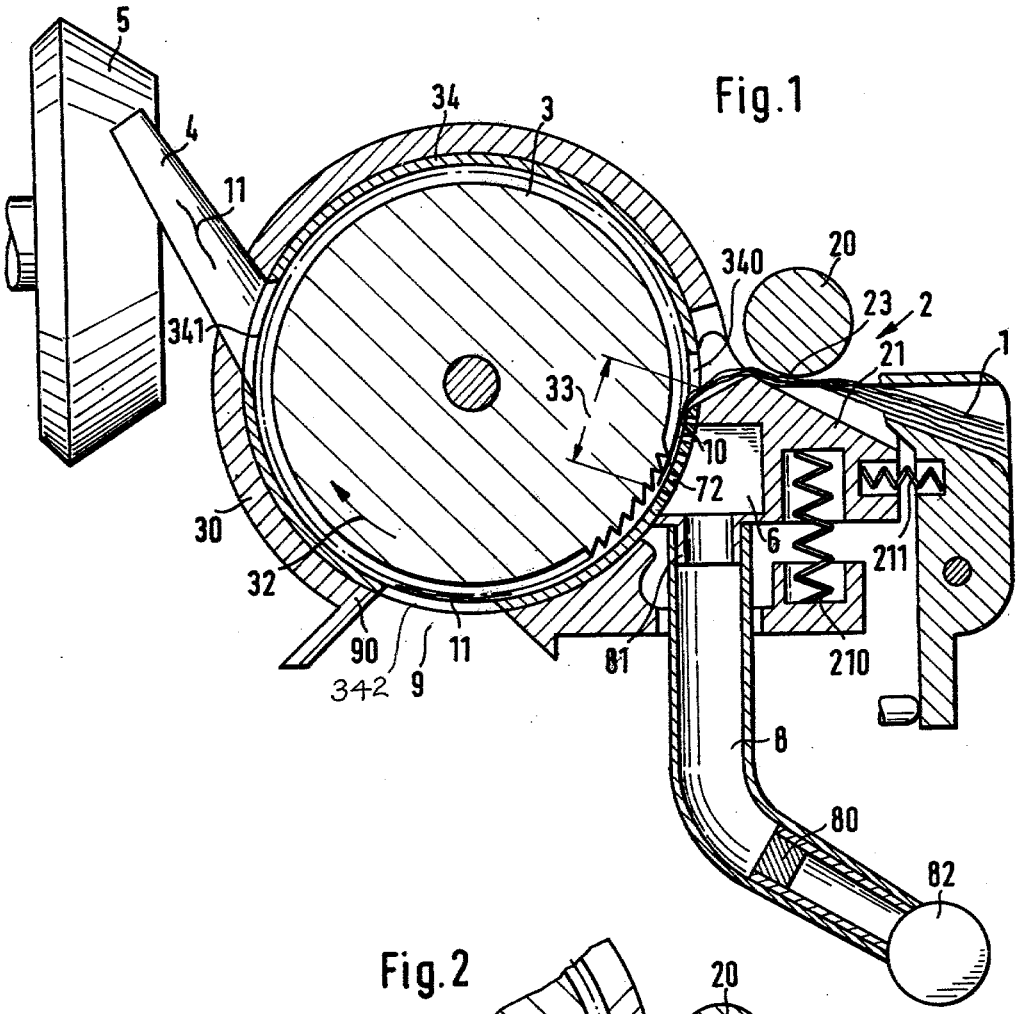
FIG. 1 is a side elevational view, partially in section, illustrating an open-end spinning device equipped with a fine dust separator constructed in accordance with the present invention.

The fibrous material is fed in the form of a sliver 1 through a feed device 2 of an opening roller 3. The feed device 2, which in principle may be otherwise constructed, exhibits in accordance with the embodiment shown in FIG. 1 a delivery roller 20 and a feeding trough 21 cooperating with it. The front end of the sliver 1 which forms a fiber tuft 10 is opened by the opening roller 3 into individual fibers 11 and, in this form, is fed through a fiber feed channel 4 of a spinning chamber 5. The particular form of the spinning chamber is without interest to the present invention. Thus, the spinning chamber 5 may be constructed for example, as a spinning rotor, as shown, but also as an open-end spinning chamber operating electrostatically or pneumatically or in any other way. The fibrous material is drawn out of the spinning chamber 5 in the form of a yarn in a known manner (not shown).

The opening roller 3 is surrounded by a housing 30 which is provided with a wear-resistant lining 34 which exhibits the necessary openings 340 and 341 for the feeding of the sliver 1 to the opening roller 3 and for the removal of the fibers 11 into the fiber feed channel 4.

In the housing 30 between the delivery device 2 and the feed chamber 5, a dust-separator opening 6 is provided which is covered by a gauze-like covering 72. The gauze-like covering 72 is an integral component of the lining 34 while the dust-separator opening 6 is provided in the feeding trough 21. The feeding trough 21 is pressed by a first compression spring 210 against the delivery roller 20 and by a second compression spring 211 against the lining 34 to make a seal.

A pipe connection 81 is provided for the feeding trough 21 and is connected to the dust-separator opening 6. A hoselike channel 8 is connected to the pipe connection. A source of suction air 82 is connected to the channel 8 via a filter 80.

The fibrous material is fed to the opening roller 3 in a known manner in the form of a sliver 1 by means of the delivery device 2. The fibers 11 are opened out of the front end of the sliver 1 by the opening roller 3 and are carried between the opening roller 3 and the lining 34 in the direction of the arrow to the fiber feed channel 4, via which they arrive in the spinning chamber 5 for spinning. The fibers make their way to the fiber feed channel past the dust-separator opening 6 while being kept by the covering 72 in the effective range of the opening roller 3.

Through the rubbing of the fibers 11 against the teeth of the lining of the opening roller 3, through the rubbing of the fibers 11 on one another, and through the rubbing of the fibers 11 against the lining 34 and against the covering 72, the microscopic dust gets rubbed off the surface of the fibers 11. In the region of the covering 72, the fibers 11 are subjected to a flow of air acting through the covering 72. The fine dust rubbed off the fibers 11 is thereby sucked out and carried away. Advantageously, the dustladen air sucked away via the channel 8 is carried away via a filter 80 and purified.

On the side next to the opening roller 3, the gauze face of the covering 72 is kept free by the fibers 11 sliding over it. The outside of the covering 72 remains free of deposits through the constant sucking away of the microscopic dust.

The dust-separator device, in accordance with the present invention, may also be used in combination with a trash-separator device for coarser particles, which exhibits a trash separator opening 9 and a separator edge 90. The construction of the trash separator device and its arrangement in the path of conveyance of the fibers is without interest to the present invention. If the housing 30 is provided with a lining 34, an opening 342 is provided therein for the trash-separator device. The device in accordance with the invention may be constructed in various ways. Thus, it is possible to provide the dust-separator opening 6 at any point in the wall 31 of the housing between the delivery device 2 and the fiber feed channel 4 (FIG. 2). The dust-separator opening 6 is covered over in continuation of the wall 31 by a gauze-like covering 7 which is fitted into the housing 30 in such a way that between the cover 7 and the wall 31, there is no projecting edge at least in the direction of conveyance as indicated by the arrow 32, against which the fibers 11 could get caught or packed together. The gauze-like covering 7 may, in that case, form part of the housing 30 in the form, for example, of a lining (FIG. 1) and/or be replaceable.

By changing the covering 7, adaptation is possible to the particular fibrous material being admitted for spinning. By appropriate selection of the width of mesh of the covering 7, the removal of microscopic dust being striven for is possible.

The width of mesh of the coverings 7 and 72 is so dimensioned that the dust escapes in the way desired, but the fibers 11 are guided past and not impeded in their motion of conveyance.

Figure 6:
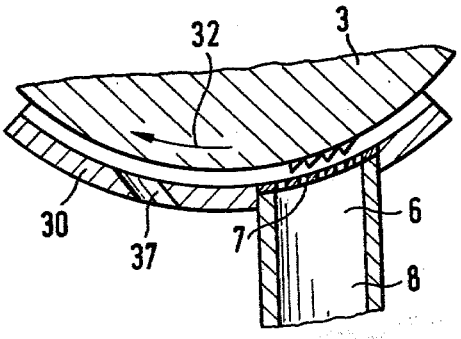
FIG. 6 is a sectional view illustrating still another modified form of the invention wherein an air supply opening is positioned in the wall of the housing following a dust-separator device.

The conveyance of the fibers 11 in the direction towards and into the fiber feed channel 4 is effected by a flow of air. Since air is sucked away through the channel 8, it may be advantageous if an air supply opening 37 (FIG. 6) follows after the covering 7 or 72 over the dust-separator opening 6 in the direction of conveyance of the fiber. If, in accordance with FIGS. 1 and 3 a trash-separator opening 9 is provided, this opening 9 may take over the function of the air supply opening since the separation of the coarse dirty matter is effected against the flow of air being fed in here.

Figure 2:
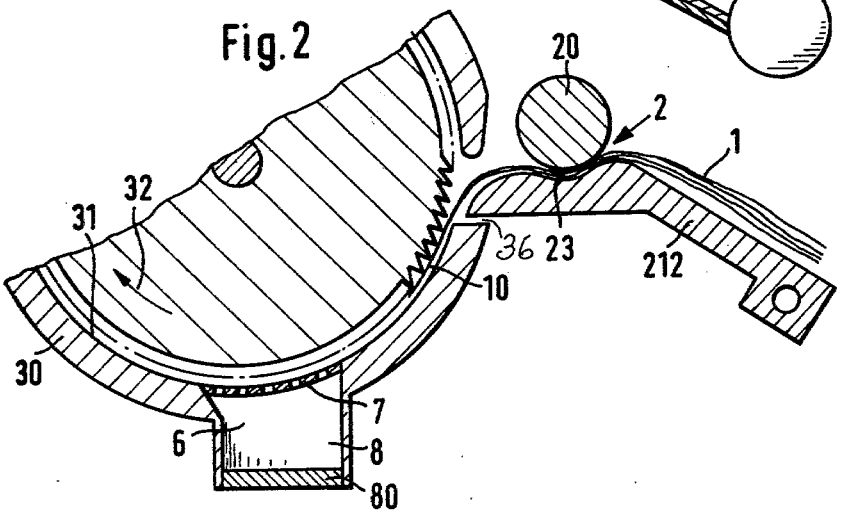
FIG. 2 is a side elevational view, partially in section, of a modified form of the invention wherein a dust-separator device is positioned outside the region of the fiber tuft.
Figure 3:
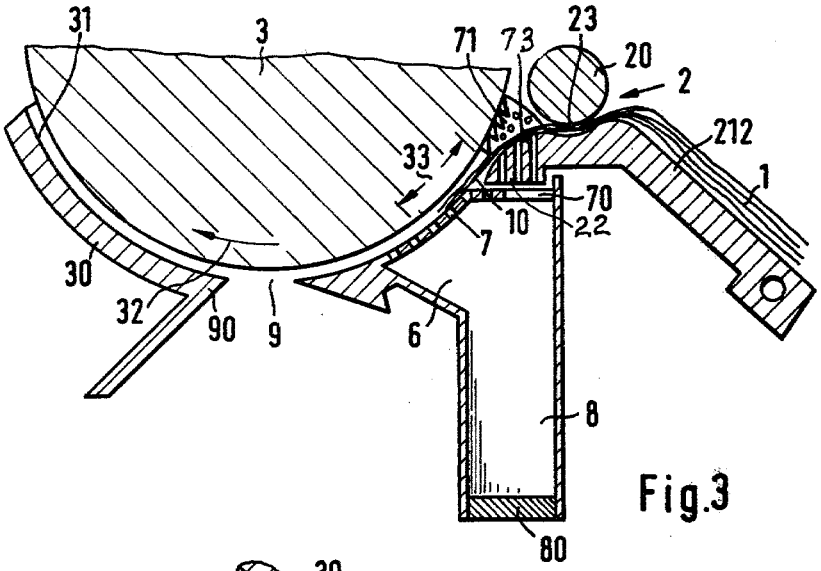
FIG. 3 is a side elevational view of still another modified form of the invention wherein a gauze-like covering is shown positioned over a dust-separator opening and is defined by a portion of a feeding trough and by a portion of the wall of the housing.
Figure 4:
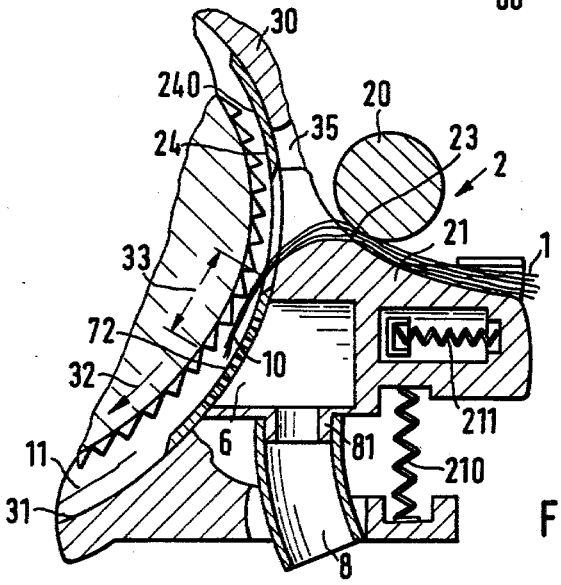
FIG. 4 is still another modified form of the invention in which a dust-separator device is an integral component of the feeding trough.

As shown in FIGS. 1, 3 and 4, the dust-separator opening 6 preferably lies in the region 33 of the housing 30 surrounding the opening roller 3, in which the fibers 11 are opened out of the fiber tuft 10 from the sliver 1 being held back by the delivery device 2.

While the fibers 11 are still getting held back by the delivery device 2, the dusty matter is getting stripped off the fibers 11 by lining/fiber, fiber/fiber and fiber/-covering friction and immediately carried away by the flow of suction air. Thereby, the components of the dust released from the fibers 11 cannot settle on the fibers 11 afresh.

The fibers 11 are conveyed in the direction of the arrow 32 in a flow of air between the opening roller 3 and the wall 31 of the housing or the lining 34 to the spinning chamber 5. This flow of air arises through the rotation of the opening roll 3.

The flow of air is further strengthened for the second time if the spinning chamber 5 is of such a construction that reduced pressure is needed for spinning. Taking into consideration the flow through the spinning air system, the effective dust-separator opening 6 over which the coverings 7 and 72 extend is so dimensioned that it extends not only under the fiber tuft 10 but also even beyond. In this way, the fine dust released from the fiber tuft 10 is safely carried away under the action of the flow of suction air acting in the channel 8. But the covering 7 or 72 should not project beyond the fiber tuft 10 by more than 50 percent of the average length of fiber. If the covering 7 or 72 projects beyond the fiber tuft 10 by more than 50 percent of the average length of fiber with increasing length of the covering 7 or 72, the danger becomes ever greater that the fine dust already sucked away can get sucked back into the fiber-air flow being carried in the direction of the arrow 32. This increases the danger of the fine dust settling in the spinning chamber 5 and leading to spinning trouble.

A flow of air conveys the fibers 11 over the dust-separator opening 6. Depending upon the strength of the flow of air sucked away through the channel 8, it may therefore be advantageous if an air supply opening 36 is provided before the dust-separator opening 6 (FIGS. 2 and 3).

As shown in FIG. 3, one part 22 of the feeding trough 212 may be made as a gauze-like covering, so that at least one part of the covering is an integral component of the feeding trough 212. If the covering 7 extends round underneath the gauze-like part 22 of the feeding trough 212 the covering 7 in this region exhibits a larger opening 70 in order to avoid clogging of the covering 7.

The feeding trough 21 may also be extended in the direction circumferential to the opening roller 3 and its end which extends from the nip 23 between the delivery roller 20 and the opening roller 3 forms a covering 73. This end is made gauze-like. The channel 8 is connected to a source 82 of suction air ending underneath part 22 of the feeding trough 21.

The feeding trough opening 35 in the housing 30 as illustrated in the embodiment shown in FIG. 4 is larger than usual since it includes the dust-separator opening 6. The feeding trough opening 35 is covered over from the inside of the housing by a diaphragm 24 which is connected to the feeding trough 21. The wall 31 of the housing is separated radially from the opening roller 3 further than usual. The inner face 240 of the diaphragm 24, however, is arranged at such a gap from the opening roller 3 that it still keeps the fibers 11 within the effective range of the opening roller 3. The dust-separator opening 6 is again arranged in the feeding trough 21 as in the case of the embodiment shown in FIG. 1. In contrast to the embodiment of FIG. 1, the feeding trough is pressed outwards by the compression spring 211 so that the diaphragm 24 is held in contact with the wall 31.

Operation of a device of this kind is the same as described above. In an embodiment of this kind (just as the embodiment of FIG. 1), it is advantageous for uniform opening of the sliver 1 that a long support for the fiber tuft 10 be provided.

The sucking away of the fine dust released is effected both in the circumferential direction outwards and also to the sides. In accordance with FIG. 3, a space (not shown) at the side of the opening region 33, likewise connected to the channel 8, is covered over by a gauze-like covering 71. Hence, the sucking away of the fine dust released from the fibers 11 is effected out of the sides, too.

As the preceding description shows, the device in accordance with the invention may be made in various ways and also be combined with a trash-separator device as known hitherto. The channel 8 may be connected directly or indirectly via an intermediate space (not shown) to the covering 7. Depending upon the feed of fiber and the degree of impurities, it may be advantageous if the reduced pressure in the channel 8 is controllable. The filter 80 may also be made as a simple filter or as a fairly large filter installation.

Figure 5:
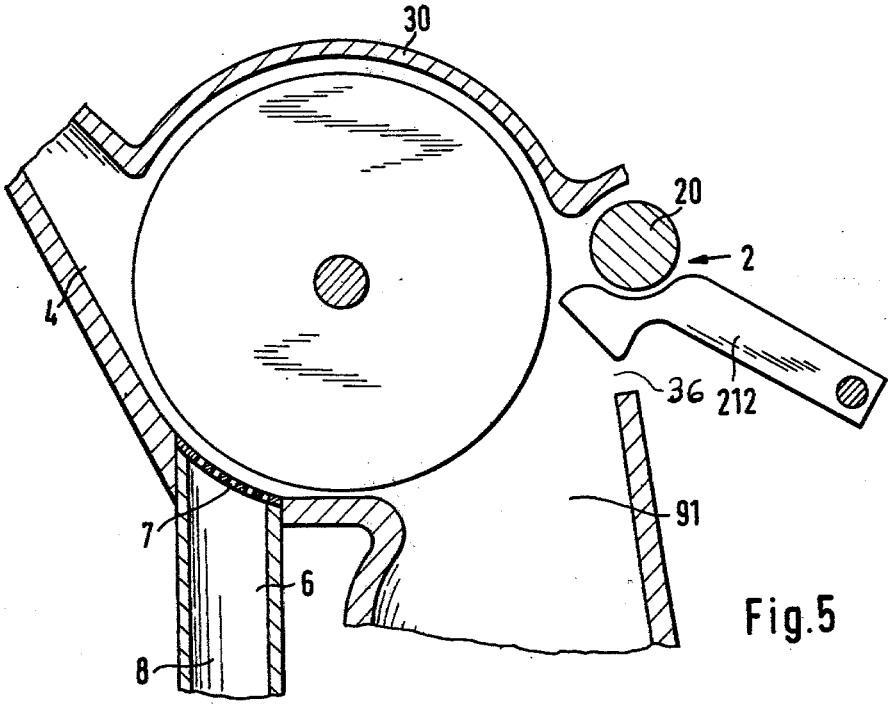
FIG. 5 illustrates still another modified form of the invention wherein the dust-separator device is positioned beyond a trash separator device provided in the wall of the housing surrounding a beater roll.

As explained in connection with FIG. 2, for the object of the invention, it plays no part in principle where on the path of conveyance the covering 7 of the dust-separator opening 6 is arranged. Hence, it is also possible to provide a dust-separator device if a trash-separator opening 91 is arranged in the direct neighborhood of the feed device 2 (FIG. 5). In this case, the dust-separator opening 6 is provided in the shell of the housing 30 between the trash-separator opening and the start of the fiber feed channel 4.

The present description shows that the object of the invention may be modified in many ways. The common feature of all embodiments is that the sliver 1 is guided in the region of influence of the opening roller 3 over a gauze-like surface, the coverings 7, 70 or 72 respectively, while at the same time, it is subjected to a flow of suction air directed outwards with respect to the opening roller 3.

What is claimed is:

1. A method of cleaning fibrous material which is fed in the form of a sliver to an opening roller and is opened by said opening roller into individual fibers and subsequently fed to an open-end spinning device, said method comprising:

simultaneously subjecting said fibrous material to the action of the opening roller and to a flow of air sucked outwards with respect to the opening roller while said fibrous material is carried in the direction circumferential to the opening roller, and subjecting said flow of air to said fibrous material while said fibrous material is still retained as a fiber tuft.

2. A device for cleaning fibrous material being fed by a delivery device to an opening roller carried within a housing, which opens said fibrous material and feeds said opened fibers to an open-end spinning device, said device comprising:

a dust-separator opening provided in said housing between said delivery device and said open-end spinning device, a source of suction connected to said dust-separator opening, a gauze-like covering being arranged in continuation of a wall of said housing extending over said dust-separator opening adjacent said opening roller maintaining said fibrous material within the effective range of said opening roller as said fibrous material is carried past during the opening process, and said dust-separator opening being positioned in said housing adjacent said delivery device in a region wherein said fibrous material is still a fiber tuft, whereby dust from said fibrous material is withdrawn through said gauze-like covering and said dust-separator opening by said source of suction.

3. The device as set forth in claim 2 further comprising:

said dust-separator opening extends in said housing in a direction from where said fibrous material is still a fiber tuft to beyond where said fibrous material is opened.

4. A device for cleaning fibrous material being fed by a delivery device to an opening roller carried within a housing which opens said fibrous material and feeds said opened fibers to an open-end spinning device, said device comprising:

a delivery roller and a feeding trough forming said delivery device, a lining carried on an inner wall of said housing between the circumferential face of said opening roller and said housing, a dust-separator opening arranged immediately behind the end of said feeding trough and extending in the direction of rotation of said opening roller from where said fibrous material is still a fiber tuft by less than 50 percent of the average fiber length to beyond the free end of said fiber tuft, a gauze-like covering extending over said dust-separator opening and being arranged such as to maintain said fibrous material within the effective range of said opening roller as said fibrous material is carried past during the opening process, and a source of suction connected to said dust-seperator opening.

5. A device for cleaning fibrous material being fed by a delivery device to an opening roller carried within a housing which opens said fibrous material and feeds said opened fibers to an open-end spinning device, said device comprising:

a dust-separator opening provided in said housing between said delivery device and said open-end spinning device, a source of suction connected to said dust-separator opening, a gauze-like covering extending over said dust-separator opening adjacent said opening roller maintaining said fibrous material within the effective range of said opening roller as said fibrous material is carried past during the opening process, said dust-separator opening extends in said housing in a direction from where said fibrous material is still a fiber tuft to beyond where said fibrous material is opened, said dust-separator opening extending in a direction of flow of said fibrous material less than 50 percent of the fiber length beyond the free end of said fiber tuft, whereby dust from said fibrous material is withdrawn through said gauze-like covering and said dust-separator opening by said source of suction.

6. A device for cleaning fibrous material being fed by a delivery device to an opening roller carried within a housing which opens said fibrous material and feeds said opened fibers to an open-end spinning device, said device comprising:

a dust-separator opening provided in said housing between said delivery device and said open-end spinning device, a source of suction connected to said dust-separator opening, a gauze-like covering extending over said dust-separator opening adjacent said opening roller maintaining said fibrous material within the effective range of said opening roller as said fibrous material is carried past during the opening process, a lining carried on an inner wall of said housing between said opening roller and said housing, said dust-separator opening extending through said lining, and said gauze-like covering extending over said dust separator forming a portion of said lining, whereby dust from said fibrous material is withdrawn through said gauze-like covering and said dust-separator opening by said source of suction.

7. A device for cleaning fibrous material being fed by a delivery device to an opening roller carried within a housing which opens said fibrous material and feeds said opened fibers to an open-end spinning device, said device comprising:

a dust-separator opening provided in said housing between said delivery device and said open-end spinning device, a source of suction connected to said dust-separator opening, a gauze-like covering extending over said dust-separator opening adjacent said opening roller maintaining said fibrous material within the effective range of said opening roller as said fibrous material is carried past during the opening process, said delivery device including, (i) a delivery roller, and (ii) a feeding trough; and at least one part of said covering is an integral component of said feeding trough, whereby dust from said fibrous material is withdrawn through said gauze-like covering and said dust-separator opening by said source of suction.

8. A device for cleaning fibrous material being fed by a delivery device to an opening roller carried within a housing which opens said fibrous material and feeds said opened fibers to an open-end spinning device, said device comprising:

a dust-separator opening provided in said housing between said delivery device and said open-end spinning device, a source of suction connected to said dust-separator opening, a gauze-like covering extending over said dust-separator opening adjacent said opening roller maintaining said fibrous material within the effective range of said opening roller as said fibrous material is carried past during the opening process, a trash-separator opening provided in said housing following said dust-separator opening, and a separator edge positioned in said trash-separator opening for removing trash from said fibrous material as said fibrous material is opened by said opening roller, whereby dust from said fibrous material is withdrawn through said gauze-like covering and said dust-separator opening by said source of suction.

9. A device for cleaning fibrous material being fed by a delivery device to an opening roller carried within a housing which opens said fibrous material and feeds said opened fibers to an open-end spinning device, said device comprising:

a dust-separator opening provided in said housing between said delivery device and said open-end spinning device, a source of suction connected to said dust-separator opening, a gauze-like covering extending over said dust-separator opening adjacent said opening roller maintaining said fibrous material within the effective range of said opening roller as said fibrous material is carried past during the opening process, an air supply opening provided in the wall of said housing which with respect to the direction of conveyance of the fibrous material is after said dust separator opening, said air supply opening is also a trash-separator opening, whereby dust from said fibrous material is withdrawn through said gauze-like covering and said dust-separator opening by said source of suction.

10. A device for cleaning fibrous material being fed by a delivery device to an opening roller carried within a housing, which opens said fibrous material and feeds said opened fibers to an open-end spinning device, said device comprising:

a dust-separator opening provided in said housing between said delivery device and said open-end spinning device, a source of suction connected to said dust-separator opening, a gauze-like covering being arranged in continuation of a wall of said housing extending over said dust-separator opening adjacent said opening roller maintaining said fibrous material within the effective range of said opening roller as said fibrous material is carried past during the opening process, and an air supply opening provided in the wall of said housing which with respect to the direction of conveyance of the fibrous material is before said dust separator opening, whereby dust from said fibrous material is withdrawn through said gauze-like covering and said dust-separator opening by said source of suction.

11. A device for cleaning fibrous material being fed by delivery device to an opening roller carried within a housing which opens said fibrous material and feeds said opened fibers to an open-end spinning device, said device comprising:

a dust-separator opening provided in said housing between said delivery device and said open-end spinning device, a source of suction connected to said dust-separator opening, and an air supply opening provided in the wall of said housing which with respect to the direction of conveyance of the fibrous material is after said dust separator opening, whereby dust from said fibrous material is withdrawn through said gauze-like covering and said dust-separator opening by said source of suction.

* * * * *